United States Patent [19]

Irwin

[11] 3,949,454

[45] Apr. 13, 1976

[54] TREATMENT OF TEXTILE FILM STRANDS

[75] Inventor: Malcolm F. Irwin, West Chester, Pa.

[73] Assignee: Textured Yarn Co., Inc., Kennett Square, Pa.

[22] Filed: June 13, 1972

[21] Appl. No.: 262,218

Related U.S. Application Data

[63] Continuation-in-part of Ser. No. 109,203, Jan. 25, 1971, abandoned.

[52] U.S. Cl. ..... 28/72.14; 28/1.6; 28/71:3; 28/DIG. 1

[51] Int. Cl.[2] ..... D02G 1/12

[58] Field of Search ..... 28/1.6, 1.7, 72.14, 72.12, 28/DIG. 1, 71.3

[56] References Cited

UNITED STATES PATENTS

| | | | |
|---|---|---|---|
| 2,954,587 | 10/1960 | Rasmussen | 28/DIG. 1 |
| 3,041,705 | 7/1962 | Sonnino | 28/1.6 |
| 3,336,174 | 8/1967 | Dyer et al. | 28/DIG. 1 |
| 3,396,443 | 8/1968 | Stanley | 28/1.6 |
| 3,402,548 | 9/1968 | Wininger, Jr. et al. | 28/DIG. 1 |
| 3,422,616 | 1/1969 | Felix | 28/DIG. 1 |
| 3,460,416 | 8/1969 | Gilbert | 28/DIG. 1 |
| 3,491,419 | 1/1970 | Satterwhite | 28/1.6 X |
| 3,571,870 | 3/1971 | Dixon et al. | 28/72.14 |
| 3,641,760 | 2/1972 | Keuchel | 28/DIG. 1 |

FOREIGN PATENTS OR APPLICATIONS

| | | | |
|---|---|---|---|
| 1,203,060 | 8/1970 | United Kingdom | 28/1.6 |
| 612,240 | 1/1961 | Canada | 28/72.12 |
| 1,030,116 | 5/1966 | United Kingdom | 28/72.12 |

*Primary Examiner*—James Kee Chi

*Attorney, Agent, or Firm*—Charles A. McClure

[57] ABSTRACT

Surface wetting of scored textile film strands facilitates fibrillation thereof. Liquid water of inert aqueous solution is applied by various means in the form of droplets or a thin surface layer to such strands, which then are compressed laterally and longitudinally to fibrillate and crimp them, as by stuffer crimping, in a continuous process optionally including predrawing the strands to increased length.

1 Claim, 14 Drawing Figures

TREATMENT OF TEXTILE FILM STRANDS

This is a continuation-in-part of my similarly entitled copending application filed Jan. 25, 1971 as Ser. No. 109,203, now abandoned.

This invention relates to fibrillation and crimping of textile film strands.

Whereas textile strands often are produced by extrusion of suitable polymeric materials into filamentary form, as through a multiplicity of holes in a spinneret, strands of more or less equivalent textile characteristics may be produced by slitting or similarly subdividing a film-like sheet of such polymeric material into narrow ribbons, strips, or tapes. The resulting textile film strands may comprise one or more of such subdivided lengths and if desired may be combined with other textile filaments by winding, twisting, etc. Suitable polymeric materials, such as polyamides, polyesters, and polyolefins (e.g., polypropylene), are drawable to orient the component macromolecules; and sheets thereof usually are drawn, to at least partial extent, to increased length before being subdivided into strand component form.

In general, textile film strands exhibit more desirable characteristics if their component narrow ribbons or strips, although continuous in length, are not wholly unitary but are partially subdivided widthwise into narrower portions attached at either end (or both ends) thereof. In order to be amenable to such partial subdivision, such strands should have scores or striations lengthwise thereof, as may have been made by suitably sharp devices that, unlike slitting knives, do not break through to the opposite side. Such partially subdivided strands are said to be fibrillated, as their attached narrower portions provide some of the characteristics of textile fibers or fibrils, such as bulk, cover, and hand.

A primary object of the present invention is improved fibrillation of textile film strands.

Another object is improved crimping of textile film strands.

A further object is continuous treatment of textile film strands to fibrillate and crimp them.

Other objects of this invention, together with means and methods for attaining the various objects, will be apparent from the following description and the accompanying diagrams.

In general, the objects of the present invention are accomplished, in treatment of textile film strands by wetting a scored film strand on its surface, laterally compressing the wet strand and thereby fibrillating it, and longitudinally compressing the strand and thereby crimping it. The lateral and longitudinal compression steps are accomplished conveniently by stuffing the strand temporarily into a laterally confining region in which the strand accumulates temporarily in a compressed mass between the entrance to the region and the exit therefrom. Drawing of the strand to increased length may be included as an earlier step in the treatment.

Figure 1:
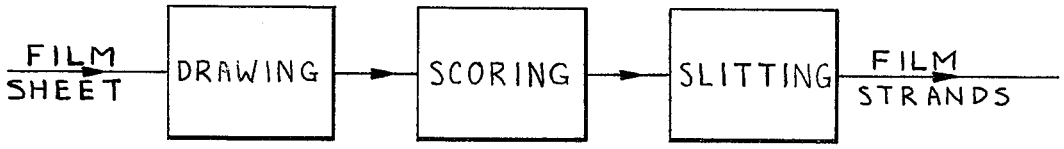
FIG. 1 is a block diagram of preparation of film strands for treatment according to this invention.

FIG. 1 indicates in block form conventional conversion of a film sheet into film strands, in which the sheet is drawn (usually orthogonally) and then scored on one or both surfaces, usually intermittently by suitably sharp means, and finally is slit into narrow funicular structures, each of which has surface scoring thereon conducive to subsequent fibrillation thereof.

Figure 2:
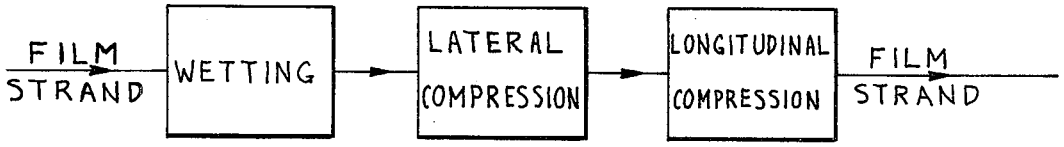
FIg. 2 is a block diagram of treatment of such film strands according to this invention.

FIG. 2 indicates treatment of such a film strand according to this invention, including the steps of wetting, laterally compressing, and longitudinally compressing it. When the latter two steps are performed as preferred in stuffer-crimping apparatus, mentioned above and described schematically below, they occur in such quick succession as to be deemed concurrent for present purposes.

Figure 3:
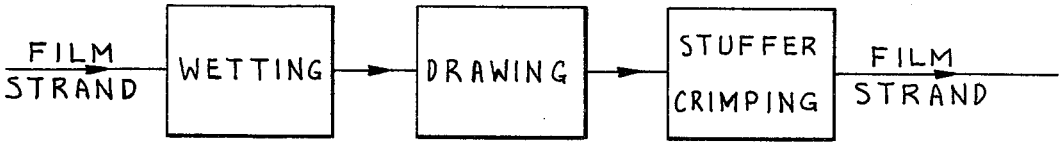
FIG. 3 is a like representation of a treatment modification.

FIG. 3 indicates a modification of such treatment, in which the wet film strand is drawn to increased length, as is preferred, before being compressed. Such drawing attenuates the strand and renders it more susceptible to lateral splitting into fibrillated form (although not requisite thereto) during compression.

Figure 4:
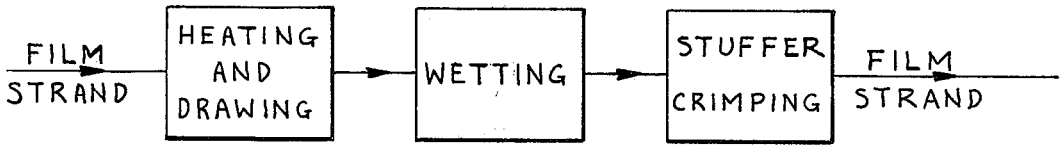
FIG. 4 is a like representation of another treatment modification.

FIG. 4 indicates another modification in which the strand is heated (usually rendering it more susceptible to drawing) and drawn to increased length and wherein the resulting attenuated strand is wetted before being compressed by stuffer crimping. Such wetting is preferably, though not necessarily, a rewetting of the strand which may have been dried during the hot drawing step.

Figure 5:
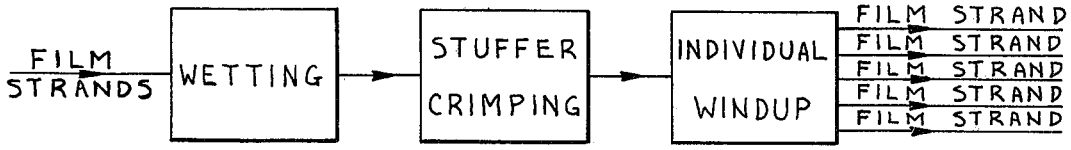
FIG. 5 is a like representation of treatment of a plurality of such film strands.

FIG. 5 illustrates such treatment of a plurality (or multiplicity) of such film strands simultaneously side-by-side, followed by individual windup of the respective fibrillated and crimped strands separately from one another, as onto discrete packages (not shown).

Figure 6:
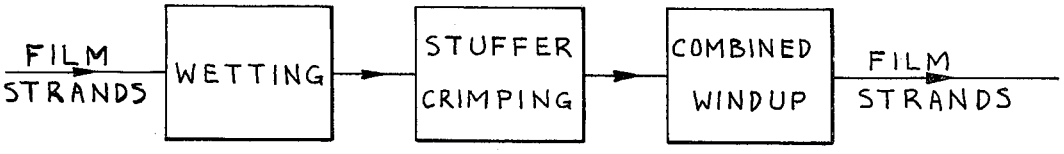
FIG. 6 is a like representation of a modification in treatment of a plurality of such film strands.

FIG. 6 is similar to FIG. 5 but illustrates combined windup of such strands, as onto a single package.

Figure 7:
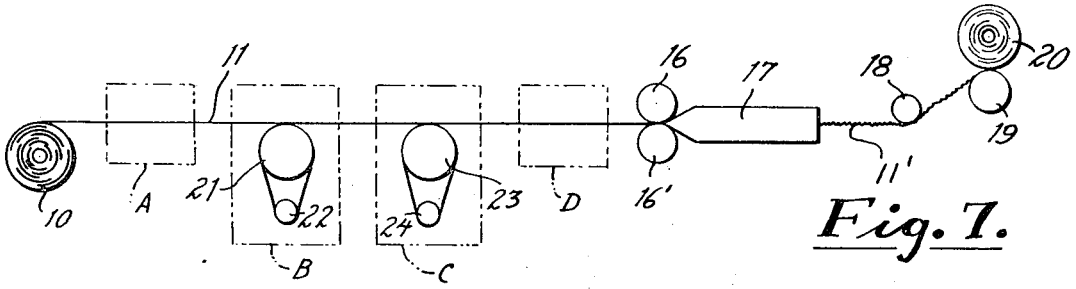
FIG. 7 is a diagrammatic view, partially in side elevation, of principal features of a continuous process and of suitable apparatus for practicing it according to the present invention.

In FIG. 7, film strand 11 is withdrawn from beam, pirn, or similar supply package 10 and is forwarded through successive treatment zones A, B, C, and D before being fed between (and laterally compressed by) pair of nip rolls 16, 16′ into stuffing chamber 17 (and therein longitudinally compressed). The nip rolls, stuffing chamber, and related supporting, driving, and other components (not shown) preferably are constructed and operated as in my U.S. Pat. Nos. 3,279,025 and 3,500,518 but may be comprised by any of many other stuffer crimpers. After accumulating temporarily in a compact mass in the chamber the strand, now fibrillated and crimped (and designated as 11' to distinguish it from entering strand 11, which itself may have had some initial crimp and/or fibrillation or not), passes over idler roll 18 by strand-traversing windup roll 19 on which rests package 20 onto which the strand is wound. Shown in zones B and C are respective pairs of godet (and separator) rolls 21, 22 and 23, 24 about which the strand passes. Means for rotating the various driven rolls are omitted from the diagram in the interest of clarity, but any conventional drive means may be interconnected suitably to rotate godet rolls 21 and 23, one or both of feed rolls 16, 16', and windup roll 19 at suitable speeds.

Where it is desired to draw strand 11 to increased length, the first godet speed, which determines the rate of withdrawal of the strand from supply package 10, is only a fraction, such as one-fourth or so, of the second godet speed. Under such circumstances, as the strand passes in non-slipping contact over the rolls in zones B and C it is drawn to increased length, such as four times the initial length (a 4X draw). The surface of the feed rolls at the entrance to the stuffing chamber approximates the latter speed, whereas the windup speed at which the strand is withdrawn from the chamber is substantially less to compensate for the shortening of the strand attributable to crimping thereof. If strand-drawing is not desired, zones B and C may be consolidated into a single treatment zone and one of the two godet roll pairs be omitted.

Zones A and D are utilized for appropriate treatment of the strand, such as preheating in zone A preparatory to drawing and/or in zone D preparatory to crimping, possibly to maintain in the latter zone a temperature increase imparted in a previous zone. The godets in zones B and/or C may be heated as well.

Figure 8:
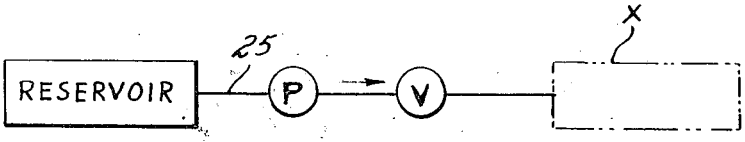
FIG. 8 is a diagrammatic view of subcomponents of or relating to FIG. 1.

Either or both of zones A and D may be utilized for the application of water or other aqueous liquid to strand 11. FIG. 8 shows schematically a reservoir thereof plus conduit 25 for the liquid to zone X, which may be any one (or more) of the various zones designated A through D. The conduit contains pump P and control valve V, whose functions are to ensure a sufficient but not excessive supply of liquid to the zone(s).

FIGS. 9 through 14 illustrate suitable means for supplying such liquid to strand 11. For convenience these various arrangements all accommodate a strand running horizontally. However, most of them (all but FIG. 7) are suited to oblique strand paths, and a couple (FIGS. 4, 5; and FIG. 6) to a vertical path as well.

Figure 9:
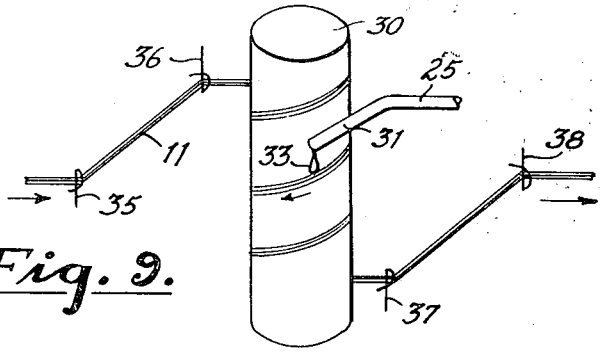
FIG. 9 is a perspective view of means for applying liquid to a running strand according to this invention.

In the FIG. 9 arrangement, the strand travels helically downward about cylinder 30 to which is juxtaposed open end 31 of liquid conduit 25 from which drop 33 of liquid is issuing onto a wrap of the strand. Strand guides 35 and 36 before, and 37 and 38 after, the point of application provide transitional constraint between the originally straight and helically modified strand paths.

Figure 10:
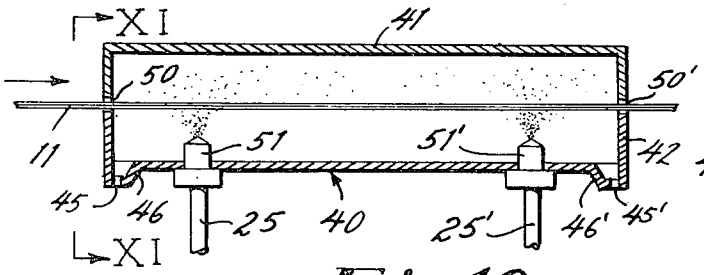
FIG. 10 is a side sectional elevation, taken at X—X on FIG. 9, of other means for applying liquid to such a running strand.
Figure 11:
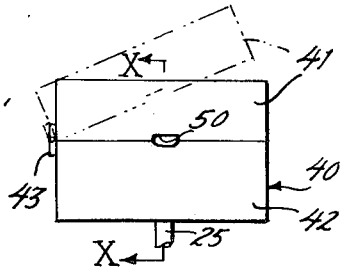
FIG. 11 is an end elevation of the last mentioned liquid application means, as indicated by XI—XI in FIG. 10.

In the FIGS. 10 and 11 arrangement, the strand travels through end openings 50, 50' in enclosure 40 (the strand being omitted from the end view of FIG. 5 for clarity). The enclosure comprises base portion 42 and openable top portion 41 secured thereto by hinge 43; the top portion being shown closed (in full lines) and alternatively partially open (in broken lines). Pair of nozzles 51, 51' on the ends of liquid conduits 25, 25' protrude into the bottom of the base portion. At its opposite bottom ends the enclosure base has sumps 46, 46' provided with weep holes 45, 45'. Fine droplets of liquid issue from the jets to fill the enclosure with a mist thereof, collecting in part on the strand as well as on the enclosure inside wall and in the sumps from which the excess drains.

Figure 12:
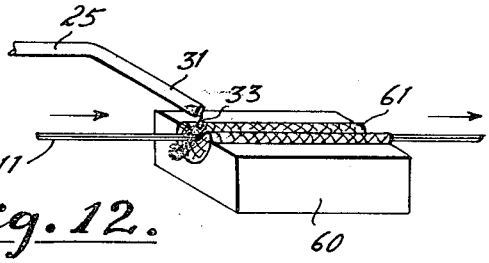
FIG. 12 is a respective view of yet other means for applying liquid to such a running strand.

In the FIG. 12 arrangement, block 60 has semicylindrical recess along its top surface to accommodate wick 61 made of suitable fibrous wicking material. The wick protrudes slightly at its edges above the surface of the block and is depressed intermediately by the strand passing thereover. Open end 31 of liquid conduit 25 is juxtaposed to the wick, and drop 33 of liquid is shown therebetween, about to wet the wick and, thus, the strand.

Figure 13:
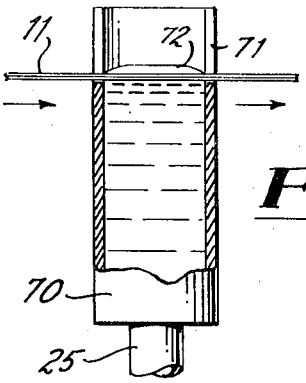
FIG. 13 is a side sectional elevation of additional means for applying liquid to such a running strand.

In the FIG. 13 arrangement, hollow cylinder 70 (shown on an enlarged scale) holds a body of liquid supplied by way of conduit 25 interconnected to the otherwise closed bottom of the cylinder. Open top 71 of the cylinder is slotted transversely, as indicated by the lack of shading on the left and right vertical edges thereof. The strand encounters meniscus 72 of liquid in passing across the liquid surface at the level of the base of the slot.

Figure 14:
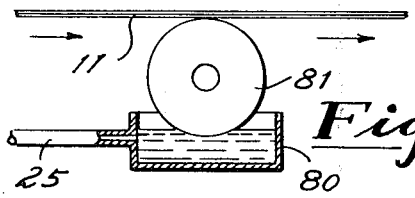
FIG. 14 is a side sectional elevation of still additional means for applying liquid to such a strand.

In the FIG. 14 arrangement, open-top vessel 80 has liquid conduit 25 interconnected to one side. Lick roll 81 mounted on a horizontal axis extends downward into the open top of the vessel and into contact with the bath of liquid therein. The running strand passes over the lick roll and rotates it by contact therewith, thereby bringing a film of liquid from the bath into contact with the strand.

It will be seen that in the arrangements of FIG. 9 and FIGS. 10, 11 the liquid is applied to the strand in the form of droplets of greater or lesser size. Optionally the flow in FIG. 9 may be augmented so as to stream onto the cylinder and the strand, as it may also in the arrangement of FIG. 12 wherein the wick acts as an intermediary in applying a more or less continuous layer of water to the strand. In the other arrangements the strand encounters a layer of water, either directly as in FIG. 13 or supplied through an intermediary lick roll as in FIG. 14. The arrangement of FIG. 9 is especially useful in zone A, although any of the illustrated (and probably other) arrangements may be used in any of the zones.

Whereas liquid water itself is useful in the practice of this invention, dilute aqueous solutions (or dispersions or emulsions) of antistatic, lubricating, surfactant, or other materials may be used instead thereof or in addition thereto. The amount of water (or aqueous liquid generally) picked up by the strand will be at least several percent by weight and preferably should be at least about ten percent. While at the preferred level the strand is considered wet, the outside surface of the strand may appear relatively dry especially in multicomponent strands wherein liquid often will be held between adjacent edges of the component tapes (or strips or ribbons). Prefibrillated strand components have additional edges available for such purpose.

Notwithstanding such exclusively external distribution of the liquid, its presence is beneficial in effecting distribution of heat and pressure applied to the strands in fibrillation and crimping, also in drawing when such step is included. Principal benefits are enhanced uniformity of overall fibrillation and crimping and permissible increase in running speed, as from several to many hundreds of yards or meters per minute without sacrifice of desired product characteristics. Other advantages doubtless will become apparent and accrue to those who undertake to practice this invention, which itself is defined in the following claims.

I claim:

1. Process of textile strand treatment comprising wetting a scored film strand, drawing the wet strand to increased length, rewetting the strand, laterally and longitudinally compressing the drawn wet strand and thereby fibrillating and crimping it.

* * * * *